US007328855B2

(12) United States Patent
Chatron et al.

(10) Patent No.: US 7,328,855 B2
(45) Date of Patent: Feb. 12, 2008

(54) SPRAY HEAD FOR A PRODUCT SUCH AS PAINT

(75) Inventors: Michel Chatron, Etoile (FR); Eric Vacher, Borg les Valence (FR)

(73) Assignee: ITW Surfaces and Finitions, Valence (FR)

( * ) Notice: Subject to any disclaimer, the term of this patent is extended or adjusted under 35 U.S.C. 154(b) by 296 days.

(21) Appl. No.: 10/514,497

(22) PCT Filed: Apr. 24, 2003

(86) PCT No.: PCT/FR03/01298

§ 371 (c)(1),
(2), (4) Date: Nov. 15, 2004

(87) PCT Pub. No.: WO03/097246

PCT Pub. Date: Nov. 27, 2003

(65) Prior Publication Data

US 2005/0218246 A1 Oct. 6, 2005

(30) Foreign Application Priority Data

May 16, 2002 (FR) ..... 02 06038

(51) Int. Cl.
*B05B 1/28* (2006.01)

(52) U.S. Cl. ..... 239/290; 239/291; 239/292; 239/297; 239/300; 239/301

(58) Field of Classification Search ..... 239/290–301, 239/600

See application file for complete search history.

(56) References Cited

U.S. PATENT DOCUMENTS

| | | | | |
|---|---|---|---|---|
| 4,537,357 | A * | 8/1985 | Culbertson et al. | 239/290 |
| 4,728,039 | A | 3/1988 | Johnson et al. | |
| 5,199,644 | A * | 4/1993 | Haferkorn | 239/296 |
| 5,209,405 | A * | 5/1993 | Robinson et al. | 239/296 |
| 5,279,461 | A * | 1/1994 | Darroch | 239/297 |
| 5,344,078 | A * | 9/1994 | Fritz et al. | 239/296 |
| 6,098,902 | A * | 8/2000 | Culbertson et al. | 239/290 |
| 6,161,778 | A * | 12/2000 | Haruch | 239/290 |
| 6,170,759 | B1 * | 1/2001 | Meyer | 239/298 |
| 6,267,301 | B1 * | 7/2001 | Haruch | 239/290 |

FOREIGN PATENT DOCUMENTS

| | | |
|---|---|---|
| AU | 526 233 B | 12/1982 |
| FR | 2 788 231 A | 7/2000 |
| GB | 288 469 A | 4/1928 |
| GB | 512 587 A | 9/1939 |

* cited by examiner

*Primary Examiner*—David D. Hwu

(57) ABSTRACT

The invention relates to a spray head for a product such as paint. According to the invention, the blow cap comprises a flat face which can be applied against a flat face of the body and the retaining ring is fixed to said body. The contact between the aforementioned faces provides sealing to the outside. In addition, the gas distributor ring is used to hold the spray nozzle and the blow cap in a concentric manner in relation to the body.

4 Claims, 2 Drawing Sheets

SPRAY HEAD FOR A PRODUCT SUCH AS PAINT

RELATED APPLICATIONS

The present application is based on International Application No. PCT/FR03/01298 filed Apr. 24, 2003, and claims priority from, French Application Number 02/06038, filed May 16, 2002, the disclosure of which is hereby incorporated by reference herein in its entirety.

FIELD OF THE INVENTION

This invention relates to spray devices for products such as paint, varnish, enamel, etc. . . . , and more specifically the spray guns.

BACKGROUND OF THE INVENTION

We know that any such spray guns, whether they are automatic or manual, comprise a spray head, which channels the product to be sprayed and the pressurized propellant gas, which is usually compressed air. Such a spray head is made up by a set of parts involved in spraying the product and which are mainly:

- a product spray nozzle
- a gas blow cap, and
- a gas distributor ring, generally referred to as the deflective ring, which supplies propellant gas to the cap and also distributes it in order to obtain a round jet and a flat jet for the sprayed product.

In the case of the existing spray guns, the nozzle is generally fixed to the body of the spray gun, which makes it rather difficult to dismount. Yet, the nozzle is a part which by its very nature needs to be cleaned or replaced rather frequently. Furthermore, in case of the existing spray guns, the course of the spray product cannot be smooth due to the nozzle being fixed to the body and this makes it even more difficult to clean.

As a solution to this drawback, patent FR-2 788 231 describes a spray head where the nozzle can be easily dismounted, while ensuring a smooth course for the spray product through the nozzle. The spray head comprises:

- a body comprising a tube to supply the spray product and an annular flat face around the free annular end of the supply tube
- a tubular spray nozzle, to which the spray product is supplied by the supply tube and fitted with a spray neck at one end and an annular flat face at the other end
- a seal that is suitable to be placed between the annular flat face of the nozzle and the free annular end of the supply tube
- a gas blow cap
- a gas distributor ring, assembled in such a way that it can be detached from the gas blow cap and supplied by pressurized gas from at least one tube envisaged in the body and which allows the cap to be supplied homogenously with gas and, possibly, to distribute the gas in such a way to vary the jet of the product at the exit of the spray neck.
- a way of screwing the gas distributor ring on the body that simultaneously allows:
  - the nozzle of the gas distributor ring and the body to be joined, and
  - to press the seal between the annular flat face of the nozzle and the free annular end of the supply tube, and

- a swivel retaining ring in order to assemble the gas blow cap and gas distributor ring in such a way that they can be detached. The gas distributor ring is threaded around its external periphery.

Therefore, in the spray head as described in this FR-2 788 231 document, the nozzle is held by pressure between the distribution ring and the body of the spray head and may be easily assembled and disassembled by tightening and loosening the parts. Furthermore, the course of the product between the spray product tube, the seal and the nozzle is not at all bumpy and can be smooth.

SUMMARY OF THE INVENTION

The aim of this invention is to perfect the spray head in order to make it easier to assemble and disassemble, mainly so that it is easier to clean and, therefore, to make the spray head particularly suitable for spray very dirty or sticky product, such as enamel for earthenware tiles.

Therefore, according to the invention, the spray head for a device to be used to spray a product, such as paint, varnish, enamel or a similar product, comprises:

- a body comprising a tube to supply the spray product and an annular flat face around the free annular end of the supply tube
- a tubular spray nozzle, to which the spray product is supplied by the supply tube and fitted with a spray neck at one end and an annular flat face at the other end
- a seal that is suitable to be placed between the annular flat face of the nozzle and the free annular end of the supply tube
- a gas blow cap
- a gas distributor ring, assembled in such a way that it can be detached from the gas blow cap and supplied by pressurized gas from at least one tube envisaged in the body and which allows the cap to be supplied homogenously with gas and, possibly, to distribute the gas in such a way to vary the jet of the product at the exit of the spray neck, and
- a swivel retaining ring, connected to the gas blow cap notable in that:
- the body has a second annular flat face around the free annular end of the supply tube
- the gas distributor ring comprises, on one side, an annular flat face which can be applied against an annular flat face of the spray nozzle and, on the other side, a second annular flat face
- the blow cap has an annular flat face which can simultaneously be applied against the second annular flat face of the body and against the second annular flat face of the gas distributor ring
- the gas distributor ring ensures the centering of the spray nozzle and of the blow cap in relation to the body, and
- the retaining ring joins with the body in order to, simultaneously:
- press the annular flat face of the blow cap against the second annular flat face of the body and against the second annular flat face of the gas distributor ring
- press the first annular flat face of the gas distributor ring against the annular flat face of the spray nozzle, and
- press the seal between the annular flat face of the nozzle and the free annular end of the supply tube so that the elements comprising the spray head, in other words the spray nozzle, the seal, the blow cap and the gas distributor ring, are assembled together in a water-tight way and joined to the body.

Therefore, the two screw links envisaged in document FR-2 788 231, between the gas distributor ring and the body and between the retaining ring and the gas distributor ring respectively, can, thanks to this invention, be replaced with a single screw link between the retaining ring and the body. It therefore facilitates assembly and disassembly and therefore cleaning. Furthermore, the spray head according to the invention, thanks to this special feature, is more compact than that in the aforementioned document.

In order to facilitate the assembly and disassembly of the spray head according to this invention even further, the retaining ring has the advantage of being joined to the body by a system of ramps which that allow the inter-assembly of consecutive elements and the joining of the later on the body by a rotation of retaining ring by turning it a fraction, for example a quarter of a turn.

The spray head according to this invention can form a single monolithic piece with the spray device or it can be added to the device.

BRIEF DESCRIPTION OF THE DRAWING

The figures on the attached drawings clearly illustrate how the invention can be made. Identical references indicate similar elements on these figures.

DETAILED DESCRIPTION OF THE INVENTION

Figure 1:
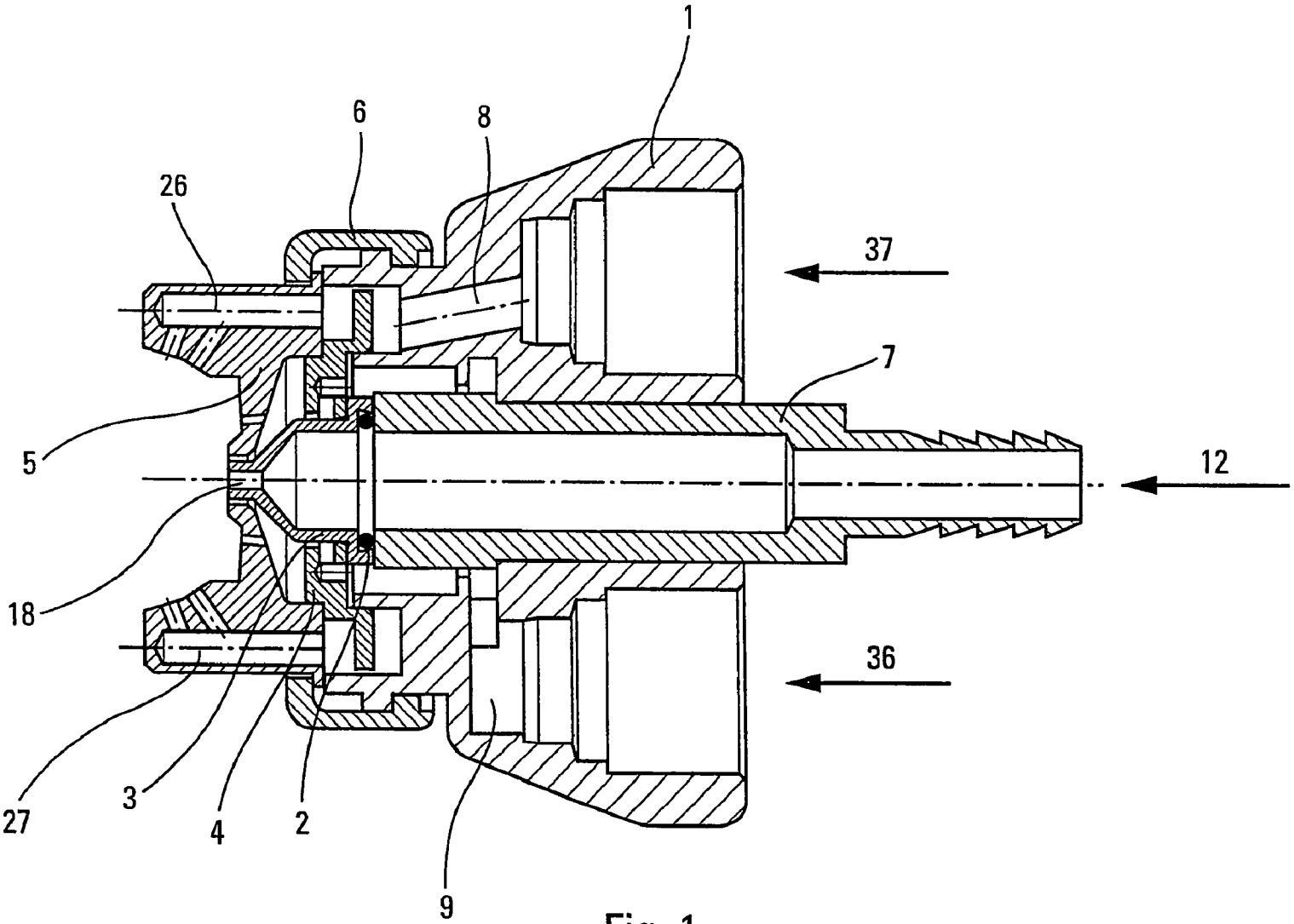
FIG. 1 is a large scale view from an axial perspective of a spray head according to this invention.
Figure 2:
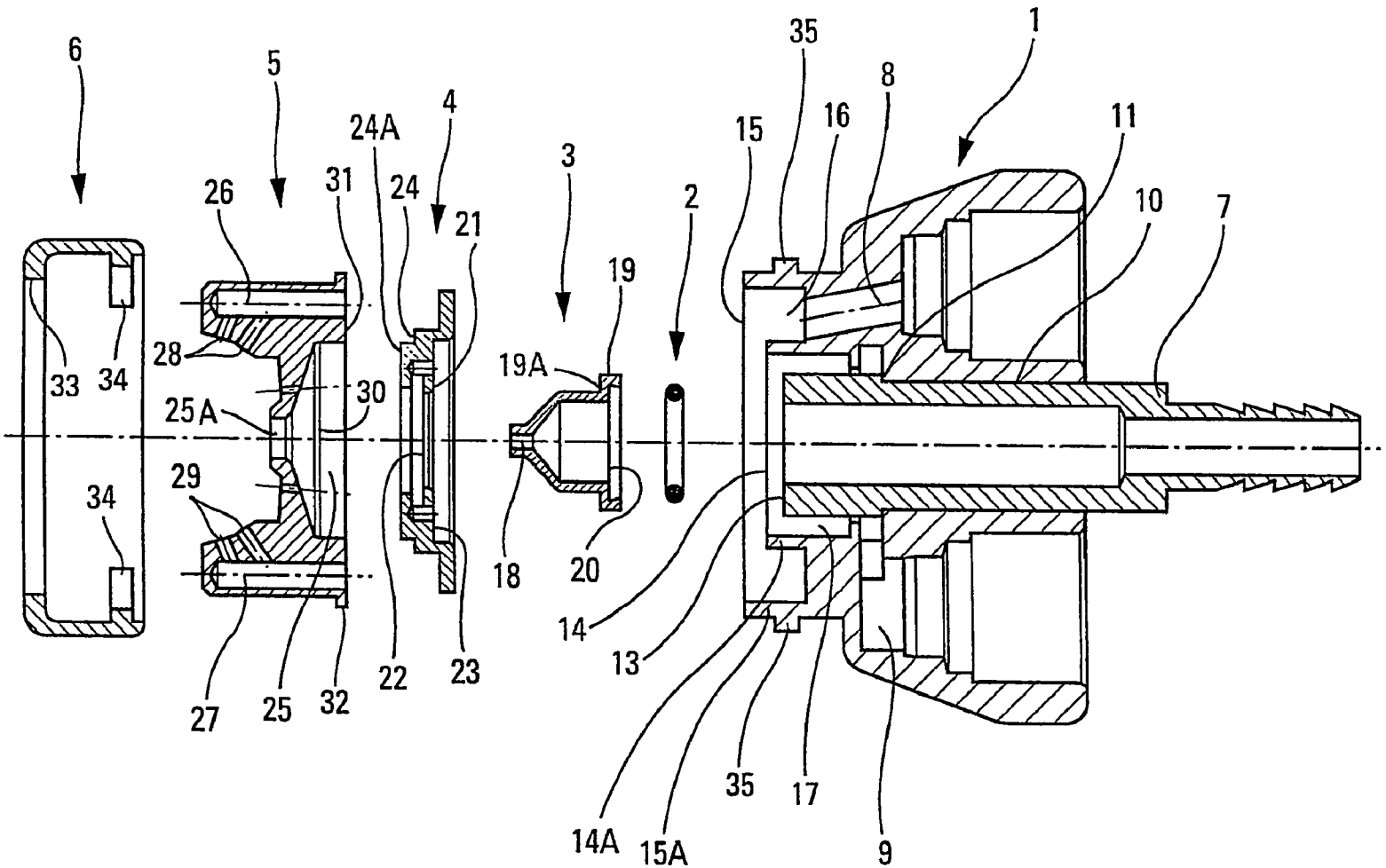
FIG. 2 is a fragmented view from an axial perspective on a smaller scale of the spray head in FIG. 1 and illustrates the different parts that make up the head.

The spray head according to this invention and shown in FIGS. 1 and 2 comprises a body 1, a seal 2, a spray nozzle 3, a gas distributor ring 4, a gas blow cap 5 and a retaining ring 6.

Body 1 of this spray head comprises an internal insert 7 to supply the spray product, together with two internal tubes 8 and 9 which supply compressed air.

Internal insert 7, for example in stainless steel, is fixed to the inside of duct 10 of body 1 and it acts as a supply duct for the spray product, whose flow is symbolized by arrow 12 in FIG. 1. The spray product comes out of internal insert 7 through free annular end 13 of the insert.

Body 1 also comprises:

- a first annular flat face 14, held by an annular crown 14A around the free annular end 13 and projecting out beyond it, and
- a second annular flat face 15, held by an annular crown 15A around the annular crown 14A and projecting out beyond the first annular flat face 14.

The internal duct 8 opens into an annular groove 16, in an opening between the annular crowns 14A and 15A, while internal duct 9 opens into annular grove 17, in an opening between annular crown 14A and insert 7.

Nozzle 3 is a tubular shape and has a spray neck 18 at one of its ends. At the other end, it has a shoulder 19 defining an annular flat face 20 on one side and an annular flat face 19A on the other.

Seal 2 is placed between the free annular end 13 of insert 7 and the annular flat face 29 of nozzle 3.

The gas distributor ring 4, for example in brass, comprises flat face 21 likely to be applied against the annular flat face 19A of nozzle 3. Therefore, this ring comprises a central neck 22 with a shoulder 23. Nozzle 3 can be gently twisted into central opening 22, with its shoulder 19 as a stop, by face 19A, against face 21 of shoulder 23. On the opposite side to flat face 21, ring 4 comprises an annular face 24 forming a shoulder with a part projecting out 24A.

The gas blow cap 5 comprises a central chamber 25 fitted with a blow neck 25A and two symmetric ducts 26, 27, which are extended by sloping blow ducts 28, 29. The projecting part 24A of ring 4 is adjusted to central chamber 25, into which it can penetrate.

Gas blow cap 5 also comprises a flat end face 31, which is suitable to be applied against annular flat face 24 of ring 4. On its outside periphery, face 31 has a shoulder 32 which allows cap 5 to be held in the retaining ring 6, which therefore acts as an additional shoulder 33. Furthermore, ring 6, inside of which blow cap 5 can be introduced, comprises a set of quarter turn ramps 34 likely to fit into an additional set of quarter turn 35 held by the annular crown 15A.

It can be easily seen from the above, that by turning the retaining ring 6 a quarter of turn on the annular crown 15A of the body (thanks to the ramp sets 34, 35 joined together and to shoulders 32, 33), it is possible, as can be seen in FIG. 2, simultaneously:

- to fix spray nozzle 3 by extending tube insert 7, by placing seal 2 between flat faces 13 and 20, with the nozzle being in the central opening 22 and pressed towards the body 1 by the shoulders 19 and 23 working together
- to apply flat face 21 of ring 4 against flat face 19A of nozzle 3, and to apply the support face 31 of blow cap 5 against face 24 of ring 4

Thus, elements 2 to 5 are assembled together by applying longitudinal pressure and they are fixed onto body 1 by means of the retaining ring 6. In the final assembly position (see FIG. 1), the blow neck 25 is linked to internal tube 9, while ducts 26, 27, 28, 29 are linked to internal tube 8.

Thus, the pressurized gas is taken along tube 9 (arrow 36) can propel the spray product taken along tube 7 and the pressurized gas taken along tube 8 (arrow 37) may shape the section of the product jet at the exit of neck 18.

Thus, thanks to this invention, a spray head can be obtained that is easy to assemble and disassemble, as well as to clean, seal 2 ensures the waterproofing between the pressurized gas circuits and the spray product circuit.

The invention claimed is:

1. A spray head, comprising:

- a body, the body further comprising an internal insert configured to supply spray product and at least one internal tube configured to supply pressurized gas, the internal insert comprising a free annular end and an annular flat face around the free annular end;
- a tubular spray nozzle configured to receive the spray product from the free annular end of the internal insert, the nozzle comprising a spray neck at one end and a shoulder at the other end, the shoulder defining a first annular flat face on one side and a second annular flat face on a second side, the spray neck configured to output a jet of spray product from the second side;
- a seal disposed between the first annular flat face of the nozzle and the free annular end of the internal insert;
- a gas blow cap;
- a gas distributor ring disposed between the spray nozzle and the blow cap, the gas distributor ring detachable from the gas blow cap and configured to receive pressurized gas from the at least one internal tube, the gas distributor ring configured to homogenously supply the cap with pressurized gas and to distribute the gas to vary a shape of the output jet of the spray product; and a swivel retaining ring rotatably connected to the gas blow cap, the retaining ring configured to join the blow cap to the body, thereby creating a waterproof assembly wherein the internal insert of the body abuts the spray nozzle, the spray nozzle abuts the gas distribution ring, and the gas distributor ring abuts the blow cap;

wherein:

the body further comprises a second annular flat face around the free annular end of the internal insert;

the gas distributor ring further comprises, a first side and a second side, an annular flat face disposed on the first side and configured to be applied against the second annular flat face of the spray nozzle, and a second side comprising a second annular flat face forming a shoulder comprising a projecting part, the second annular flat face of the gas distributor ring configured to be applied against by the blow cap; and the blow cap comprises an annular flat face configured to be simultaneously applied against the second annular flat face of the body and against the second annular flat face of the gas distributor ring.

2. The spray head according to claim 1 wherein the retaining ring and the body comprise a system of ramps configured to join the body, the seal, the spray nozzle, the gas distributor ring, and the blow cap, consecutively by a rotation of the retaining ring.

3. In combination, the spray head according to claim 1 and a spray device.

4. A spray head, comprising:

a body comprising a supply tube configured to supply spray product, the supply tube comprising a free annular end and an annular flat face around the free annular end;

a tubular spray nozzle, the tubular spray nozzle fitted with a spray neck at one end and a shoulder at the other end that defines a first annular flat face on one side and a second annular flat face at the other end, the spray neck configured to output a jet of spray product;

a seal removeably disposed between the first annular flat face of the nozzle and the free annular end of the supply tube;

a gas distributor ring, the gas distributor ring comprising a central opening, a first annular flat face arranged to be applied against the second annular flat face of the spray nozzle, a second annular face disposed opposite the first annular flat face of the gas distributor ring, the second annular face on the second side of the gas distributor ring forming a shoulder comprising a projecting part, wherein the gas distributor ring is configured to distribute gas through the central opening on the second annular flat face of the gas distributor ring to vary a shape of the jet of spray product;

a gas blow cap, comprising an annular flat face arranged to be simultaneously applied against the second annular flat face of the body and against the second annular flat face of the gas distributor ring, and a central chamber fitted with a blow neck and two symmetric ducts that are extended by sloping blow ducts, the central chamber configured to receive the projecting part of the gas distributor ring; and a swivel retaining ring connected to the gas blow cap, the retaining ring configured to join with the body, thereby simultaneously pressing:

the annular flat face of the blow cap against the second annular flat face of the body and against the second annular flat face of the gas distributor ring;

the first annular flat face of the gas distributor ring against the second annular flat face of the spray nozzle; and the seal between the first annular flat face of the nozzle and the free annular end of the supply tube;

wherein the body, the spray nozzle, the seal, the gas distributor ring, and the blow cap, are consecutively joined together forming a water-tight assembly.

* * * * *